United States Patent [19]

Richter

[11] 4,044,981

[45] Aug. 30, 1977

[54] PAPERBOARD PALLET

[75] Inventor: Robert Horace Richter, Fort Wayne, Ind.

[73] Assignee: The Magnavox Company, Fort Wayne, Ind.

[21] Appl. No.: 695,697

[22] Filed: June 14, 1976

[51] Int. Cl.[2] ..... B60P 7/00

[52] U.S. Cl. ..... 248/119 R; 206/386; 229/14 C

[58] Field of Search ..... 248/119 R; 229/14 C; 108/51.3, 55.3; 206/386

[56] References Cited

U.S. PATENT DOCUMENTS

| | | | |
|---|---|---|---|
| 2,603,350 | 7/1952 | Lehman | 229/14 C |
| 2,730,287 | 1/1956 | Mueller | 206/386 |
| 3,249,445 | 5/1966 | Hackett | 229/14 C |
| 3,424,364 | 1/1969 | Grafslund | 206/386 |
| 3,650,459 | 3/1972 | Tucker | 206/386 |
| 3,675,765 | 7/1972 | Melsek | 206/386 |

*Primary Examiner*—Robert A. Hafer
*Attorney, Agent, or Firm*—George R. Pettit; William J. Streeter

[57] ABSTRACT

A low cost paperboard pallet is provided to transport delicate cargo such as television receivers and fine furniture in a safe manner. The invention allows a cargo to be secured and removed in an upright position avoiding any requirement to tip or support the cargo in an other than normal orientation.

8 Claims, 5 Drawing Figures

PAPERBOARD PALLET

BACKGROUND OF THE INVENTION

The present invention relates to a pallet for transporting delicate cargo such as furniture in a safe manner. Specifically, a pallet is provided to transport the delicate cargo.

In an effort to prevent damage to delicate home furnishings, furniture manufacturers and other consumer product manufacturers expend considerable sums for packaging containers, crates, pallets, padding, etc. Some of the pallets used previously to transport a cargo are shown in U.S. Pat. No. 3,648,959 and U.S. Pat. No. 3,675,765. A disadvantage of these shipping pallets is the requirement of tipping the cargo on one side to allow the pallet to be fastened to or removed from the underside of the cargo. Tipping the cargo to one side requires additional handling and adds cost to the final consumer product. Also, the risk of damage to the cargo during the fastening or removing operation is increased by tipping the cargo.

Wood materials have generally been used in the past to manufacture pallets. This adds undue weight to the total cargo load and increases the cost of shipping. Additionally, the base of the cargo is subject to being damaged due to foreign matter coming into contact with the base. The cost and risk of damage incurred using prior art packing devices increases the final purchase prince paid by the consumer.

The pallet of this invention provides an apparatus for supporting delicate consumer products during shipment from manufacturer to consumer. The pallet may be inexpensively manufactured in large quantities and weighs less than wood, thereby reducing total shipping costs which add to the price of the consumer product. Additionally, the risks of damage to the cargo are minimized by the pallet of this invention as the cargo may be secured to and removed from the pallet with a minimum of handling, and most importantly, without tipping.

SUMMARY OF THE INVENTION

Accordingly, it is an object of this invention to provide a pallet for transporting a delicate cargo.

It is another object of this invention to provide means for fastening a delicate cargo to a pallet which does not require excessive handling of the cargo during the fastening operation.

It is another object of this invention to provide a low cost pallet structure which reduces the risk of damage to the cargo.

These and other objects are provided by the invention described herein.

A sheet of paperboard forming the top surface of a pallet is configured in a manner which will allow mounting a cargo to the pallet without tipping the cargo. A vertical rib is formed by folding the paperboard sheet and screws or other fastening means are used to fasten the vertical rib to the cargo thereby securing the cargo to the pallet. The paperboard material used to construct the pallet also provides mechanical damping or shock absorption between the cargo and the pallet should a sudden force be experienced by the pallet. Means for reinforcing the vertical rib mounting structure are also provided for use with heavier cargo. Protective flaps are provided along the edges of the paperboard sheet in one embodiment of the invention to keep extraneous matter from coming into contact with the base of the cargo. The paperboard sheet is secured to a base which may consist of additional paperboard sheets bonded together. The overall structure is adapted for inexpensive manufacture and high volume production.

DESCRIPTION OF THE PREFERRED EMBODIMENT

Figure 1:
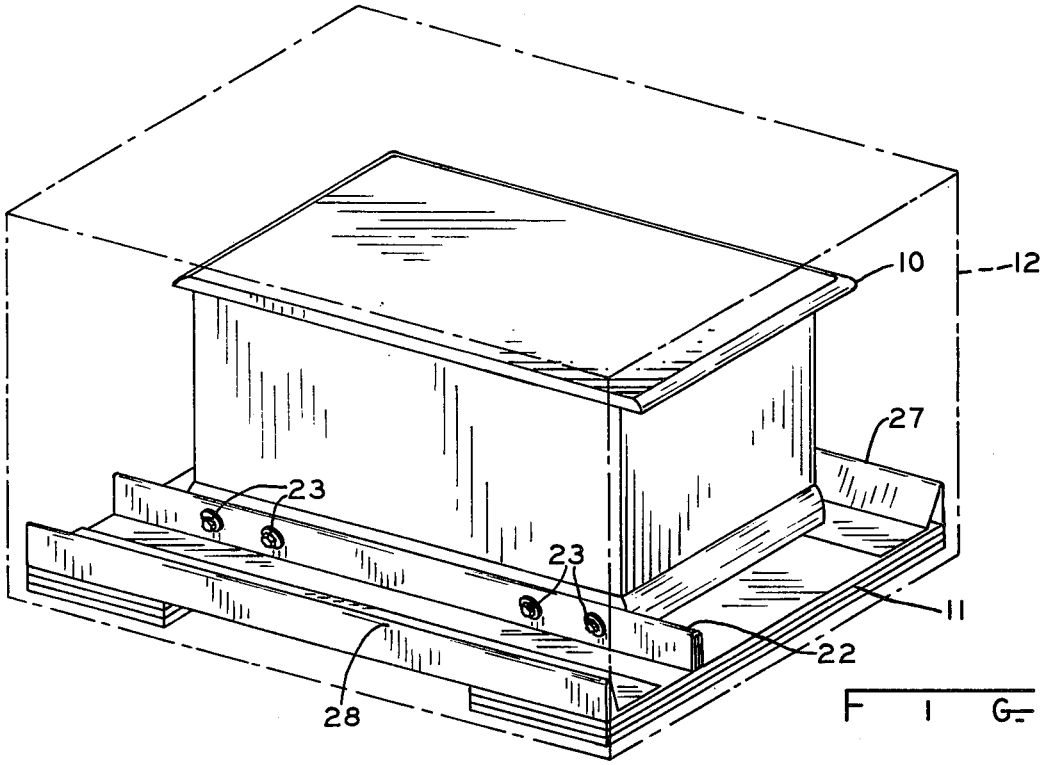
FIG. 1 shows the apparatus of this invention supporting a cargo within a shipping container.

Referring now to FIG. 1, the apparatus of this invention is shown in its intended environment. A consumer product 10 such as a television receiver is located on a pallet 11 and secured to the pallet 11 in a manner to be explained. The television receiver-pallet assembly is shown enclosed within a carton 12 suitable for shipping.

Figure 2:
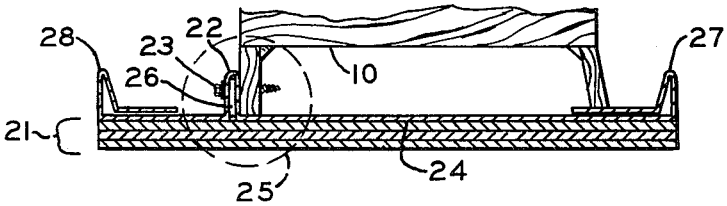
FIG. 2 is a partial end view of an embodiment of the pallet of this invention supporting a cargo.

FIG. 2 is an end view of the pallet-cargo assembly showing the details of the pallet construction. The pallet for supporting the cargo comprises a first sheet 24 of laminated paperboard or the like configured in the manner shown and a base 21. The paperboard sheet 24 is folded to form a vertical rib 22 protruding above the rest of the surface of the sheet. The paperboard is first scored along three parallel lines to define adjacent strip portions. It is then folded to bring the strip portions of the lower surface into facing relationship, resulting in the upstanding rib 22. The ends of the paperboard sheet may be folded in the embodiment shown first upwardly, then downwardly at an angle, and then inwardly with a strip portion in contact with and bonded to the upper surface of the paperboard sheet 24 to form a set of flaps 27, 28.

The vertical rib 22 is used to fasten the cargo to the pallet so that the pallet may be moved with the cargo securely fastened. Within the vertical rib there is located in the embodiment shown a slat or member for reinforcing the vertical rib 22. The vertical rib may be alternately formed by forming vertical flaps on the ends of two separate sheets of paperboard. The two sheets may then be bonded to a base with the flaps facing each other. Where a reinforcing slat is desired, space is left between the two flaps before bonding the sheets to the base. Where no slat is required, the flaps of the two separate sheets are placed in contact with each other and a base is thereafter secured to the underside of the two sheets.

Figure 3:
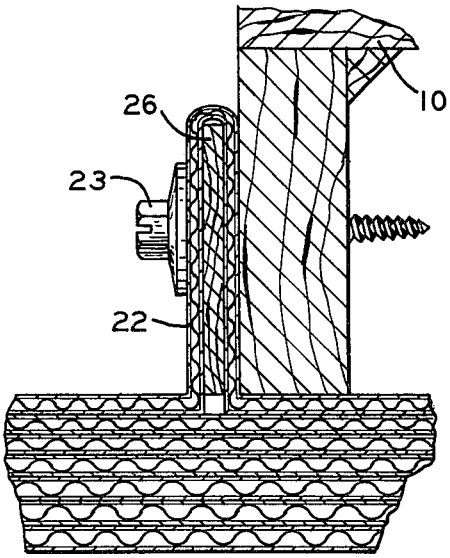
FIG. 3 is an enlarged partial view of the means for securing the cargo to the pallet.

Details of the means for fastening the cargo to the pallet of FIG. 1 are shown in FIG. 3. FIG. 3 is an enlarged view of that portion of FIG. 2 enclosed within circle 25. The vertical rib 22 in the paperboard sheet 24 is shown with a wooden slat 26 as a reinforcing member. A woodscrew 23 is shown fastening the vertical rib 22, slat 26, and cargo 10 together. Other fastening means will be obvious to those skilled in the art. Those skilled in the art will recognize that the slat 26, which may be formed of wood, plastic, steel, etc., is merely for adding strength to the combination and may be deleted where lighter cargoes are to be transported, thus reducing the cost and weight of the pallet.

With the apparatus described in the foregoing figures. because the screws 23 are readily accessable, the cargo may be fastened to the pallet structure and removed therefrom without tipping the cargo on one of its sides. Where delicate furniture-type cargo is being transported, mounting of this cargo in the manner shown reduces the risk of damage to the cargo which can result from tipping the cargo on its side. Also, previous pallets which require the cargo to be tipped or oriented in a direction other than its normal upright position may require the expenditure of considerable man power to attach it securely to pallet. The method of securing a cargo to the pallet employed by this invention reduces the amount of labor and time required to securely fasten the cargo to a pallet for shipping.

The apparatus described not only reduces the time and risk of damage incurred while affixing a cargo, but also provides a lighter and lower cost pallet that accordingly reduces the total delivered cost of the cargo. As can be seen by those skilled in the art, the entire structure may be made of paperboard folded and configured in the manner shown with a minimum of expense.

The paperboard construction will provide between the pallet and the television receiver or other delicate cargo a certain amount of mechanical damping. Thus, a sudden force experienced by the pallet will be damped before being transmitted to the cargo.

The vertical flaps 27 and 28 may be used to provide additional strength, to provide increased surface area for bonding carton 12 to the pallet, and to help protect the base of the cargo from foreign matter. Where the cargo consists of finely finished furniture, it will be appreciated that the protective feature becomes valuable. However, the folds 27, 28 are merely illustrative only of one embodiment of this invention, and those skilled in the art may choose to alter or eliminate the folds 27, 28 depending on their specific needs.

The paperboard sheet 24 forming the top of the pallet is bonded to one or more base members 21 which may be formed of a plurality of additional paperboard sheets bonded together by glue or other adhesives, or the base member may be any material suitable for the particular use contemplated. Also, the apparatus described in this application will allow for continuous transportation from final assembly in the case of consumer electronic products to final delivery to the customer's home, reducing handling costs and risk of damage to the cargo.

Figure 4:
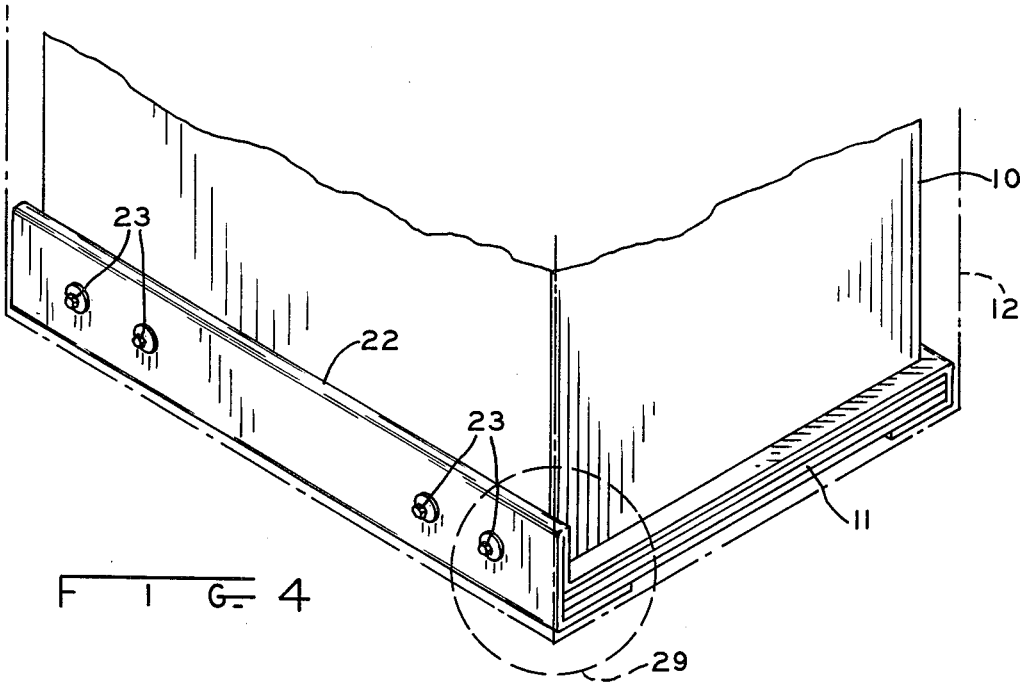
FIG. 4 shows another embodiment of the pallet of this invention supporting a cargo within a shipping container.
Figure 5:
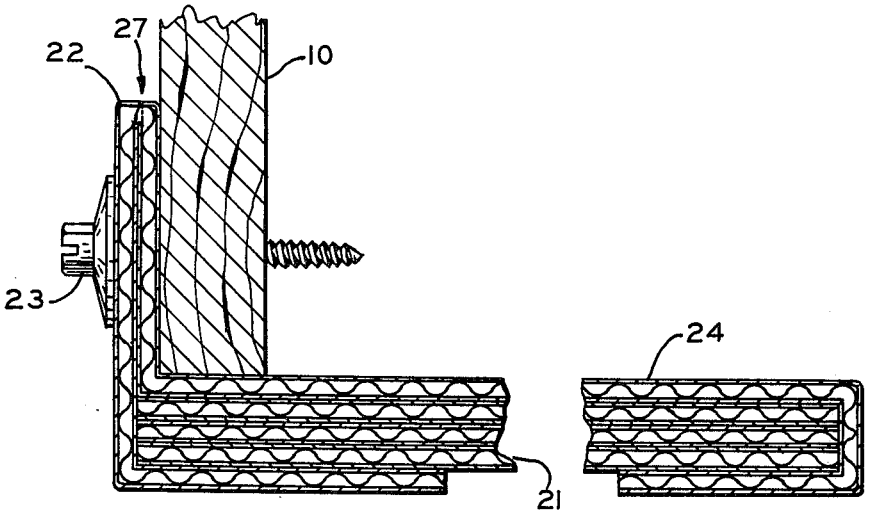
FIG. 5 is an enlarged partial view of a portion 29 of FIG. 4.

FIGS. 4 and 5 illustrate another embodiment of this invention. The vertical rib is shown at one edge of the upper surface comprising the top, bottom, and mounting structure of the pallet. A single sheet 24 forms a continuous surface comprising the top, bottom, and mounting structure of the pallet. A filler material 21 of paperboard or the like is used to reinforce the pallet. The fastening means 23 securing the cargo 10 to the pallet is shown as a screw and washer.

The strip portions of the paperboard sheet that form the upstanding rib may be left unbonded, or may be bonded together or to a reinforcing member. For ease of manufacture, it may be desirable to apply adhesive to the facing strip surfaces after the sheet 24 has been bonded to one or more base members. In this case, the top of the vertical rib 22 shown in FIG. 5 or FIG. 3 may be cut along line 27 and the two strip portions may then be glued together.

Thus there is described a pallet for transporting delicate cargo in an inexpensive and efficient manner. Those skilled in the art will recognize various modifications which may be implemented without departing from the invention described more particularly by the claims that follow.

What is claimed is:

1. A pallet for supporting cargo comprising:

a. a paperboard sheet having an upper surface and a lower surface;

b. an upstanding rib formed by folding said sheet so that adjacent strip portions of said lower surface are in facing relationship;

c. a base member beneath said sheet, the upper surface of said base member bonded to at least a portion of the lower surface of said sheet; and d. means for securing a cargo residing on said paperboard sheet to said upstanding rib.

2. The pallet of claim 1 wherein said adjacent strip portions are bonded together.

3. A pallet for supporting cargo comprising:

a. a paperboard sheet having an upper surface and a lower surface;

b. an upstanding rib formed by folding said sheet so that adjacent strip portions of said lower surface are in spaced apart facing relationship;

c. a reinforcing member positioned between said facing portions;

d. a base member beneath said sheet, the upper surface of said base member bonded to at least a portion of the lower surface of said sheet; and e. means for securing a cargo residing on said paperboard sheet to said upstanding rib.

4. The invention of claim 3 wherein said adjacent strip portions are bonded to said reinforcing member.

5. A pallet for supporting a cargo comprising:

a. a first paperboard sheet having one end folded upwardly to form a vertical flap perpendicular to said sheet;

b. a second paperboard sheet having one end folded upwardly to form a vertical flap perpendicular to said sheet;

c. said paperboard sheets positioned whereby said vertical flaps are in facing relationship with each other;

d. a base member beneath said first and second paperboard sheets, the upper surface of said base member bonded to a portion of the lower surface of said first and second paperboard sheets; and e. means for securing a cargo residing on one of said paperboard sheets to said vertical flaps.

6. The apparatus of claim 5 wherein said flaps are bonded together.

7. A pallet for supporting a cargo comprising:

a. a first paperboard sheet having one end folded to form a vertical flap perpendicular to said sheet;

b. a second paperboard sheet having one end folded to form a vertical flap perpendicular to said sheet;

c. said paperboard sheets positioned whereby said vertical flaps are in spaced apart facing relationship;

d. a reinforcing member positioned between said vertical flaps;

e. a base member beneath said sheets, the upper surface of said base member bonded to at least a portion of the lower surface of each of said sheets; and f. means for securing a cargo to said vertical flaps for reducing relative movement between said cargo and said paperboard sheets.

8. The apparatus of claim 7 wherein said flaps are bonded to said reinforcing member.

* * * * *